US010492546B2

(12) United States Patent
Gehlen et al.

(10) Patent No.: US 10,492,546 B2
(45) **Date of Patent: *Dec. 3, 2019**

(54) GARMENT WITH INTEGRATED SPEAKERS

(71) Applicant: Groove Watersports, LLC, Lincoln, NE (US)

(72) Inventors: Grant P. Gehlen, Lincoln, NE (US); Steven A. Rose, Minneapolis, MN (US); Jaclyn M. Tejeda, Lincoln, NE (US)

(73) Assignee: Groove Watersports LLC, Lincoln, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/899,044

(22) Filed: Feb. 19, 2018

(65) Prior Publication Data

US 2018/0168244 A1 Jun. 21, 2018

Related U.S. Application Data

(63) Continuation of application No. 15/076,171, filed on Mar. 21, 2016, now Pat. No. 9,894,943.

(60) Provisional application No. 62/135,895, filed on Mar. 20, 2015.

(51) Int. Cl.

| | |
|---|---|
| ***A41D 1/00*** | (2018.01) |
| ***H04R 1/02*** | (2006.01) |
| ***H04R 1/44*** | (2006.01) |
| ***A41D 13/00*** | (2006.01) |

(52) U.S. Cl.

CPC ..... *A41D 1/005* (2013.01); *A41D 13/0015* (2013.01); *H04R 1/028* (2013.01); *H04R 1/44* (2013.01); *H04R 2201/023* (2013.01); *H04R 2201/028* (2013.01)

(58) Field of Classification Search

CPC .. A41D 13/0015; A41D 1/02; A41D 13/0012; A41D 13/012; A41D 3/00; A41D 1/005; A63B 71/12; G08B 17/06; H04R 5/023; H04R 5/02

See application file for complete search history.

(56) References Cited

U.S. PATENT DOCUMENTS

| | | | | | |
|---|---|---|---|---|---|
| 2,285,083 | A | | 6/1942 | Cover, Sr. | |
| 4,539,700 | A | | 9/1985 | Sato | |
| 4,825,471 | A | * | 5/1989 | Jennings | A41D 1/002 2/115 |
| 4,860,364 | A | * | 8/1989 | Giannini | G10H 1/00 2/20 |
| 4,876,724 | A | * | 10/1989 | Suzuki | H04R 5/023 2/250 |
| 5,326,297 | A | | 7/1994 | Loughlin | |
| 5,563,951 | A | * | 10/1996 | Wang | G02C 11/06 381/301 |
| 5,635,909 | A | * | 6/1997 | Cole | A62B 17/003 2/93 |
| 7,023,338 | B1 | | 4/2006 | Foth | |
| 7,035,422 | B1 | | 4/2006 | Wiener | |
| 7,440,581 | B2 | * | 10/2008 | Wiener | H04R 5/023 381/301 |

(Continued)

*Primary Examiner* — Tajash D Patel

(74) *Attorney, Agent, or Firm* — Merchant & Gould P.C.

(57) ABSTRACT

The present disclosure provides a garment that includes integrated waterproof impact resistant speakers. Related methods of manufacturing the garment are also provided herein.

21 Claims, 17 Drawing Sheets

(56) References Cited

U.S. PATENT DOCUMENTS

| | | | | |
|---|---|---|---|---|
| 8,834,222 | B2 * | 9/2014 | Ewing | B63C 9/11 441/106 |
| 9,894,943 | B2 * | 2/2018 | Gehlen | A41D 1/005 |
| 2006/0099864 | A1 | 5/2006 | Crumrine et al. | |
| 2008/0187166 | A1 * | 8/2008 | Ko | H04R 5/023 381/388 |
| 2008/0267440 | A1 | 10/2008 | Alden | |
| 2009/0311928 | A1 | 12/2009 | McClintock et al. | |
| 2011/0019861 | A1 | 1/2011 | Wolfe | |
| 2011/0075874 | A1 * | 3/2011 | Richards | H04R 5/023 381/334 |
| 2013/0279729 | A1 * | 10/2013 | Richards | H04R 5/023 381/333 |

* cited by examiner

GARMENT WITH INTEGRATED SPEAKERS

CROSS-REFERENCE TO RELATED APPLICATION

This application is a continuation application of U.S. patent application Ser. No. 15/076,171 filed Mar. 21, 2016, now U.S. Pat. No. 9,894,943, which claims the benefit of utility application provisional application Ser. No. 62/135,895 filed Mar. 20, 2015, which is incorporated herein by reference in its entirety.

TECHNICAL FIELD

The present disclosure provides a garment having integrated speakers and related methods of manufacturing the same.

BACKGROUND

Garments are worn in a number of different potentially wet and rugged environments. For example, buoyant vests are commonly worn by wakeboarders, water skiers, and kite boarders. During such water activities it is often desirable to play music. However, to provide music to the athlete during wakeboarding or water skiing, the volume of the music must be very high in part due to the relatively large distance between the athlete and the tow boat. Headphones are not ideal for use in these types of environments as they can be lost and/or cause injury to the athlete when the athlete impacts the water. There is a need in the art for garments having integrated waterproof impact resistant speakers.

SUMMARY

The present disclosure provides a garment that includes integrated waterproof impact resistant speakers. Related methods of manufacturing the garment are also provided herein.

DETAILED DESCRIPTION

Figure 1:
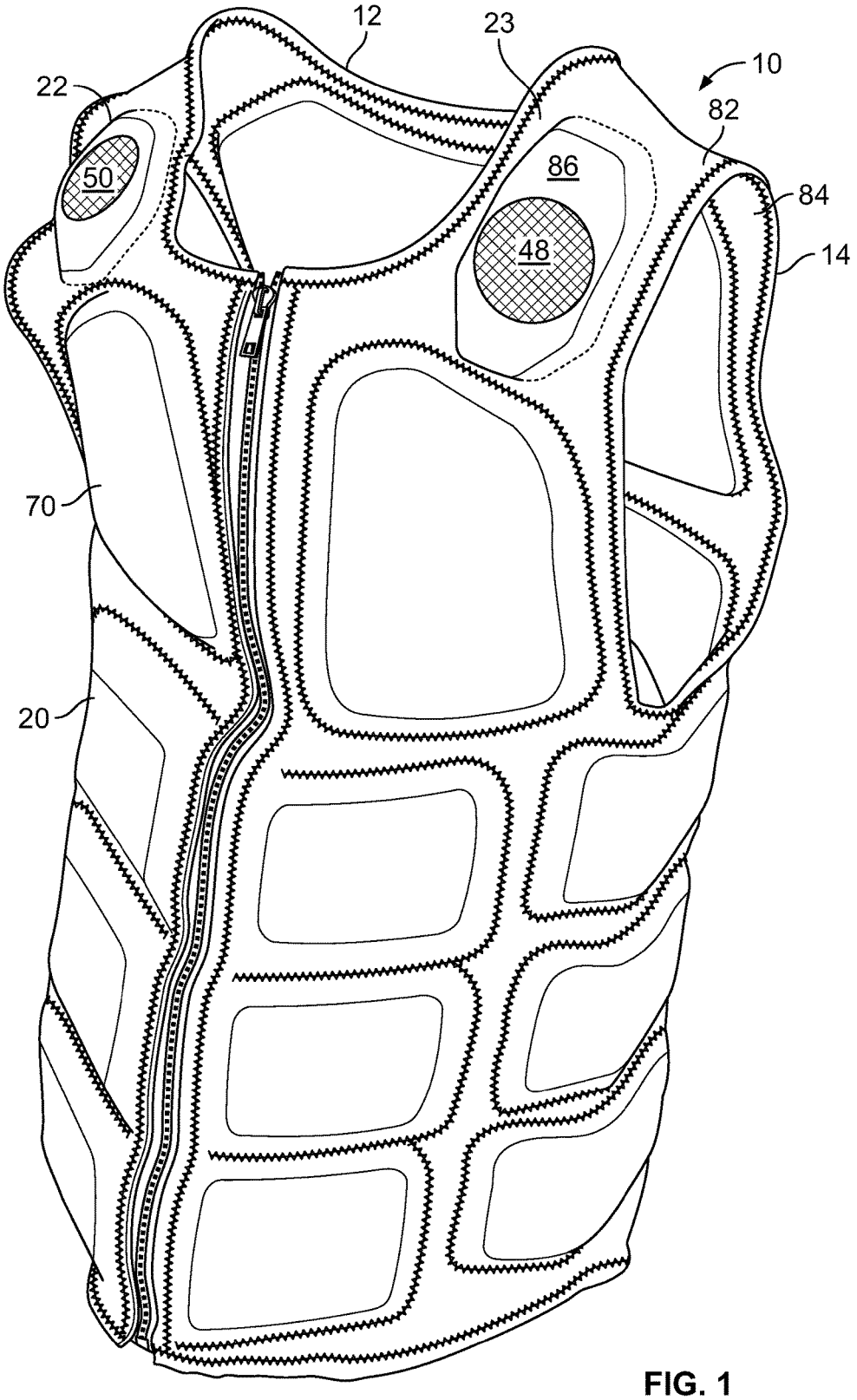
FIG. 1 is a front perspective view of a garment according to an embodiment of the present disclosure.
Figure 2:
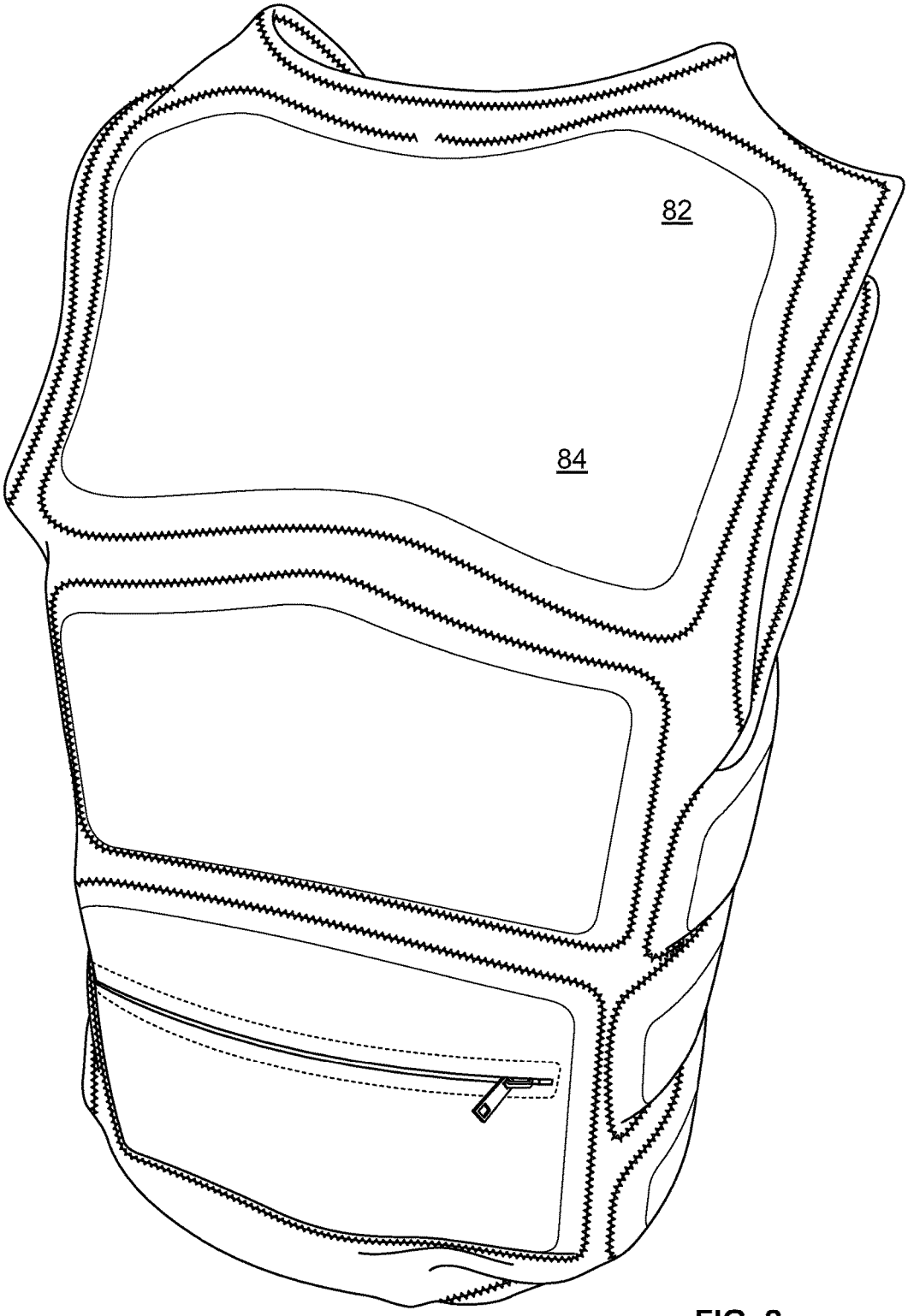
FIG. 2 is a rear perspective view of the garment of FIG. 1.
Figure 3:
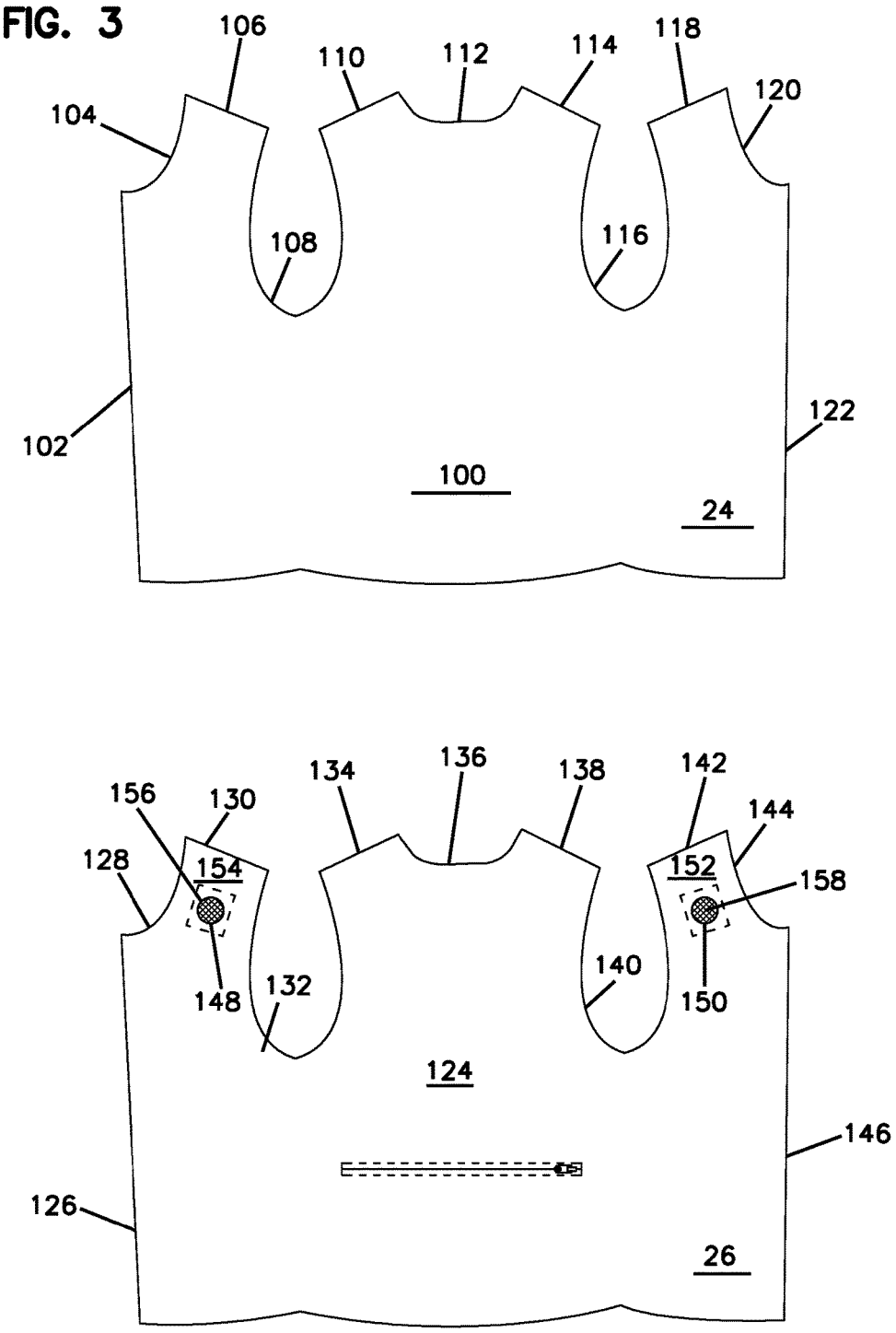
FIG. 3 is a partially assembled view of the garment of FIG. 1.
Figure 4:
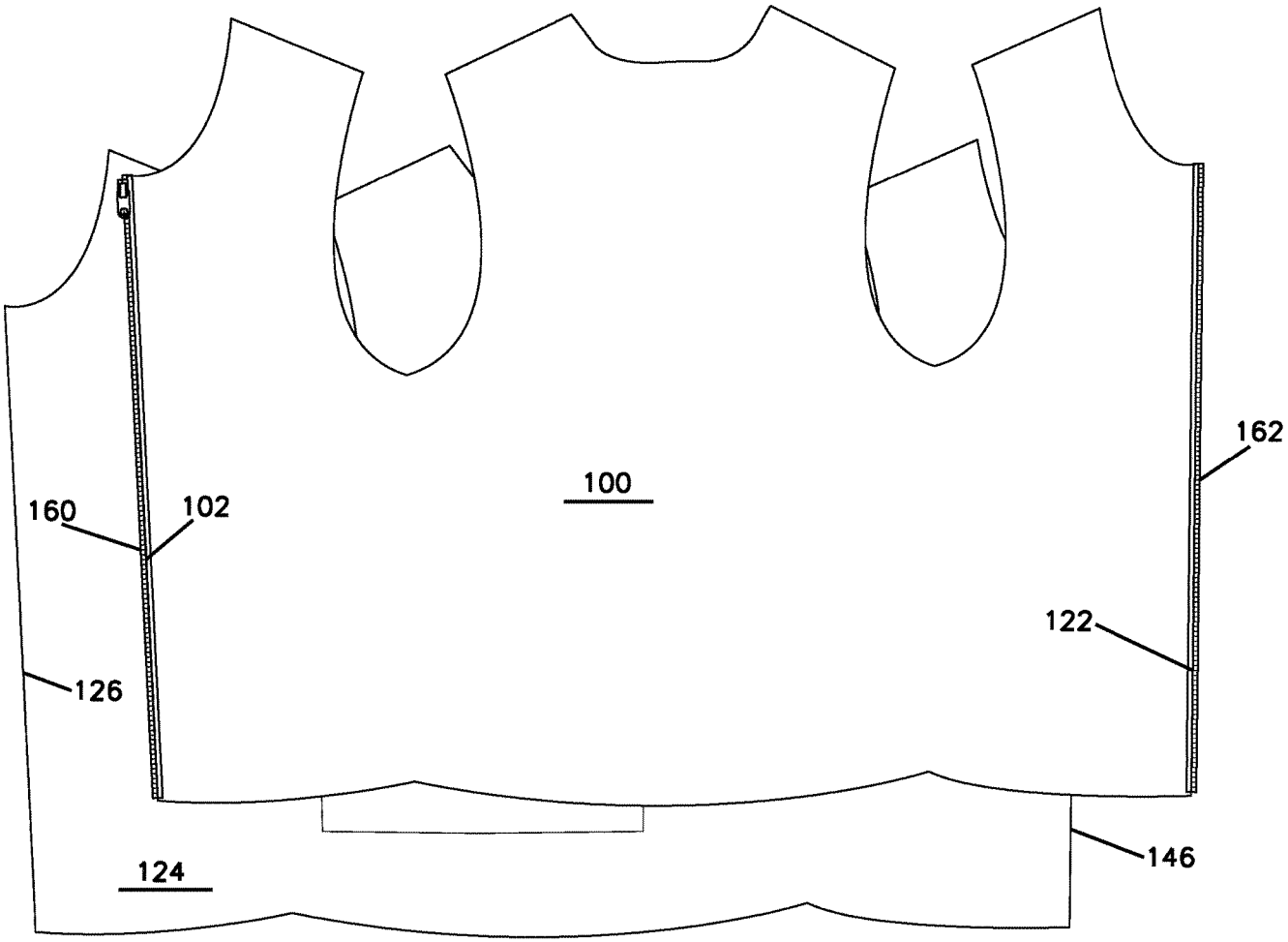
FIG. 4 is a partially assembled view of the garment of FIG. 1.
Figure 5:
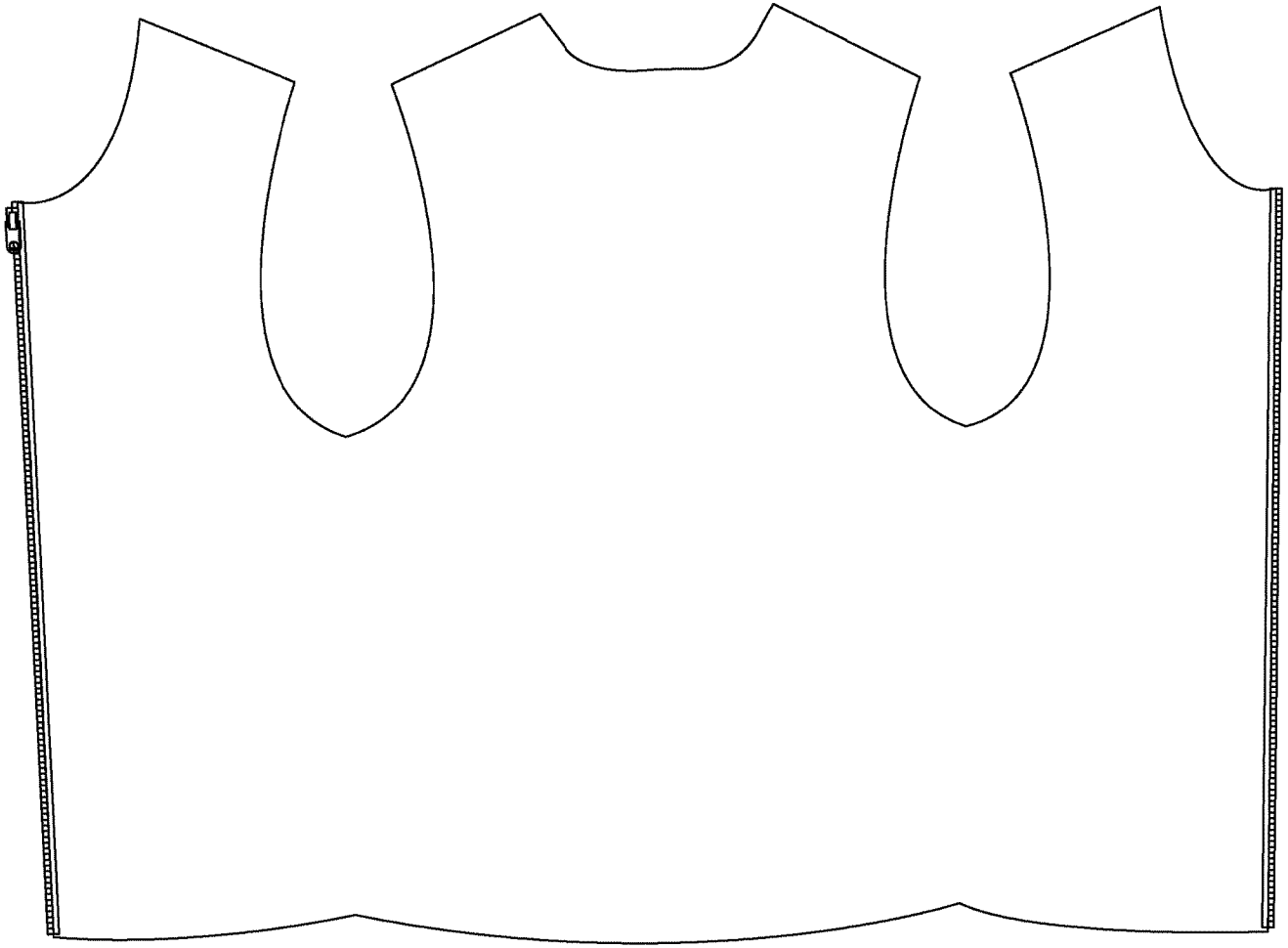
FIG. 5 is a partially assembled view of the garment of FIG. 1.
Figure 6:
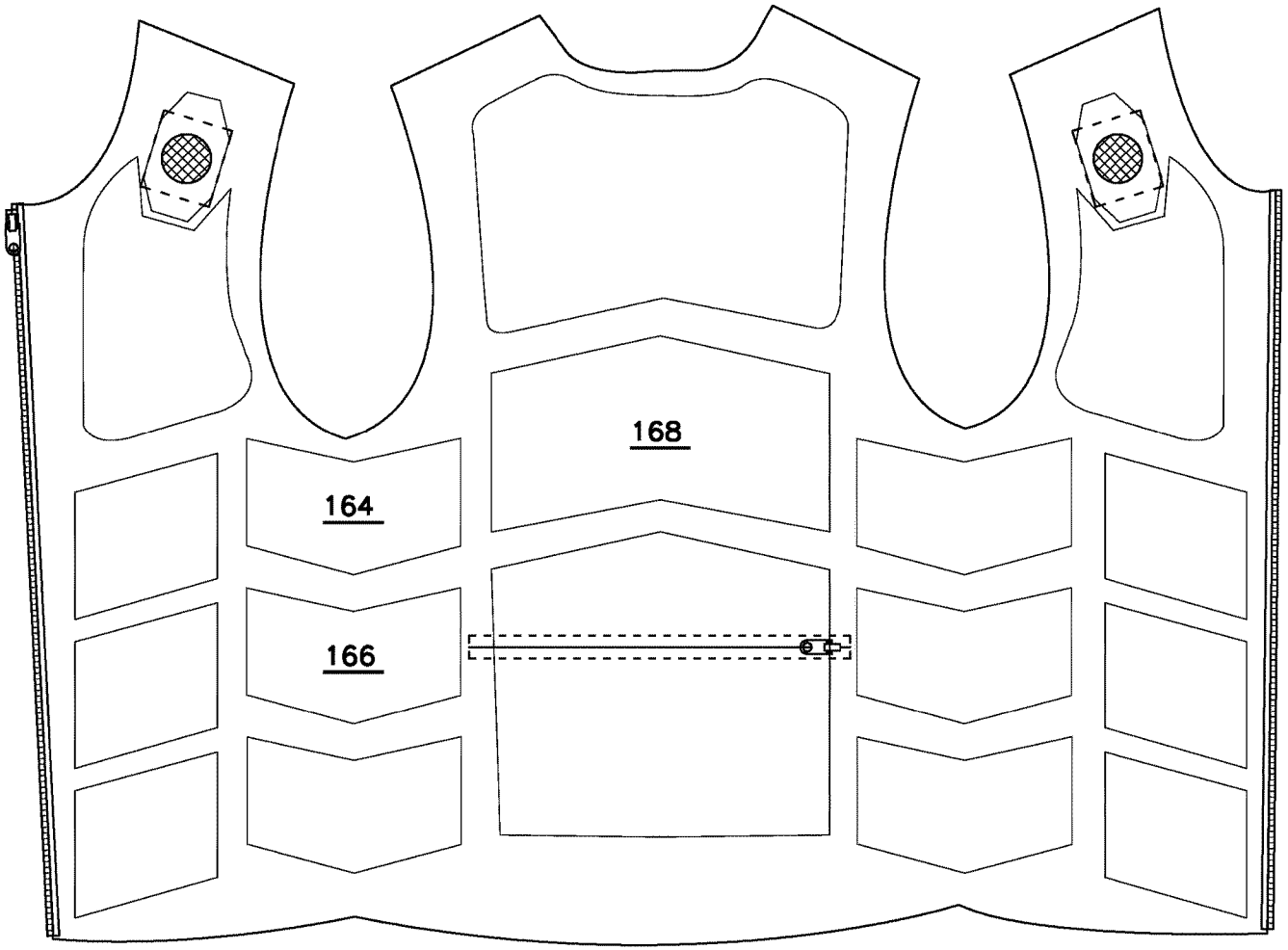
FIG. 6 is a partially assembled view of the garment of FIG. 1.
Figure 7:
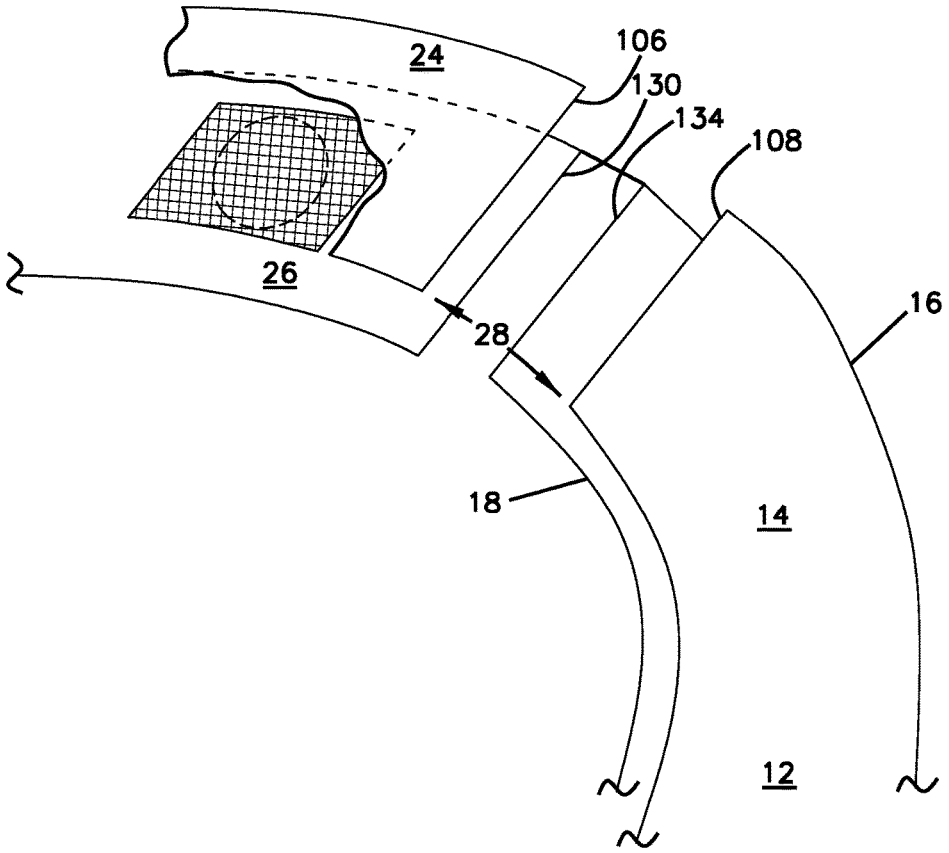
FIG. 7 is a partially assembled view of the garment of FIG. 1.
Figure 8:
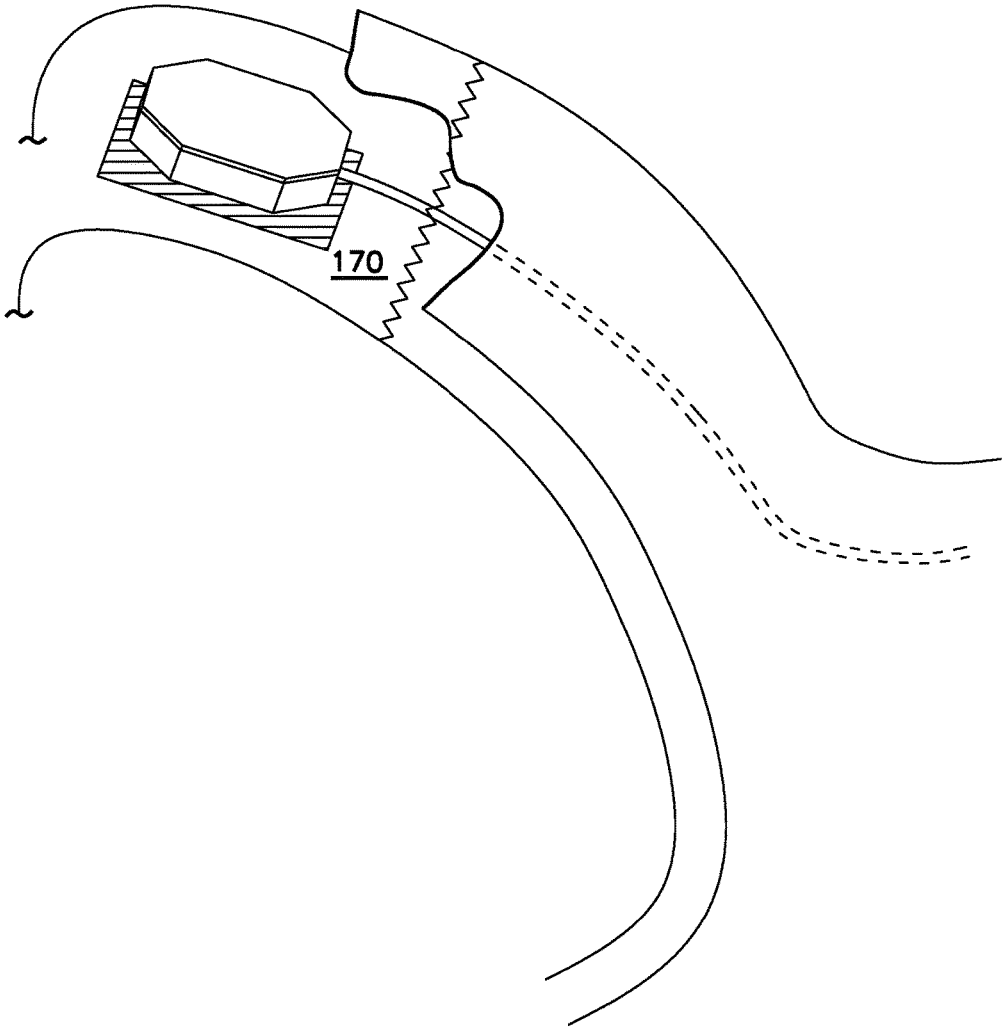
FIG. 8 is a partially assembled view of the garment of FIG. 1.
Figure 9:
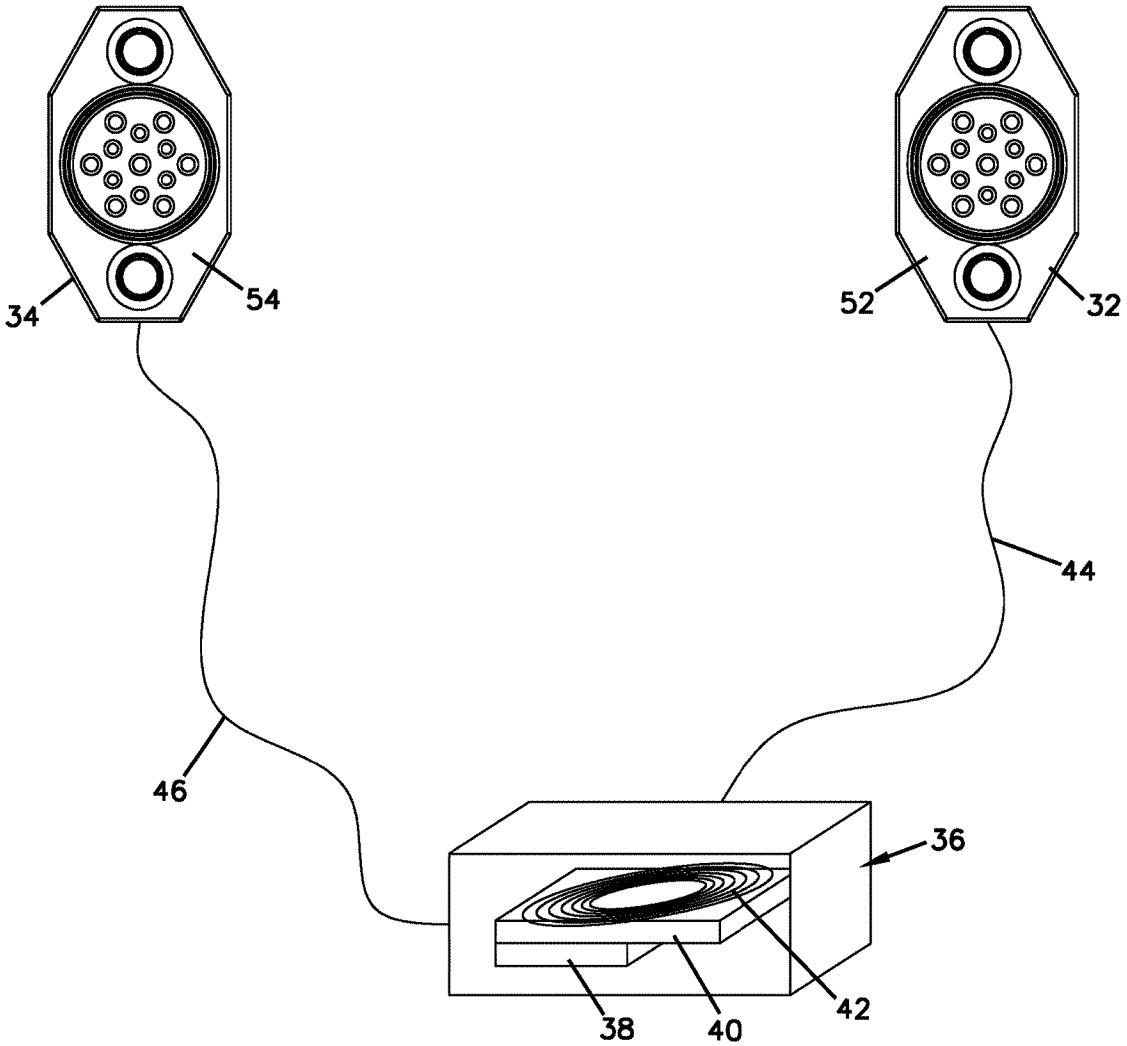
FIG. 9 is a partially assembled view of certain electrical components of garment of FIG. 1.
Figure 10:
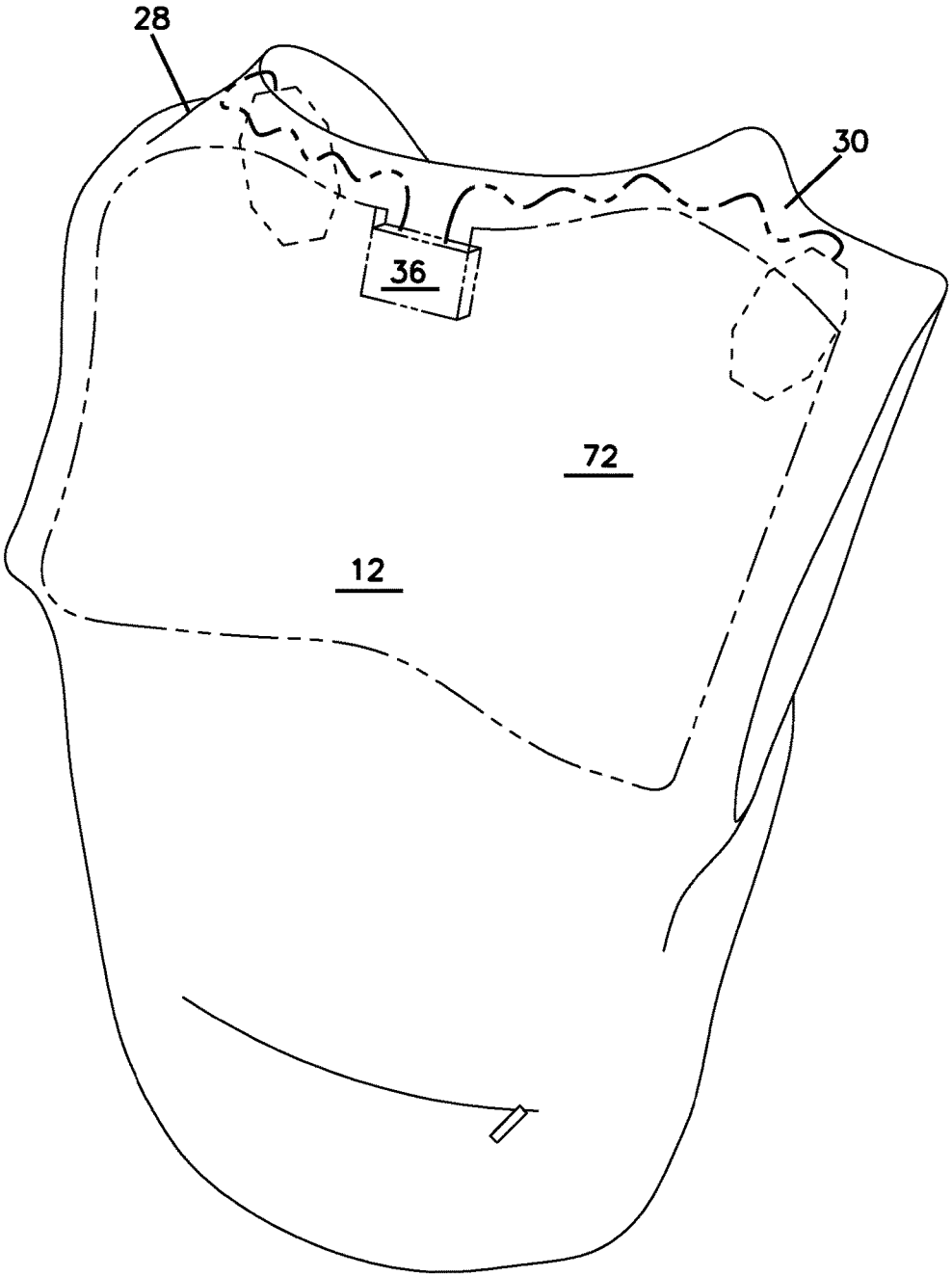
FIG. 10 is a partially assembled view of the garment of FIG. 1 with the components of FIG. 9 integrated therein.
Figure 11:
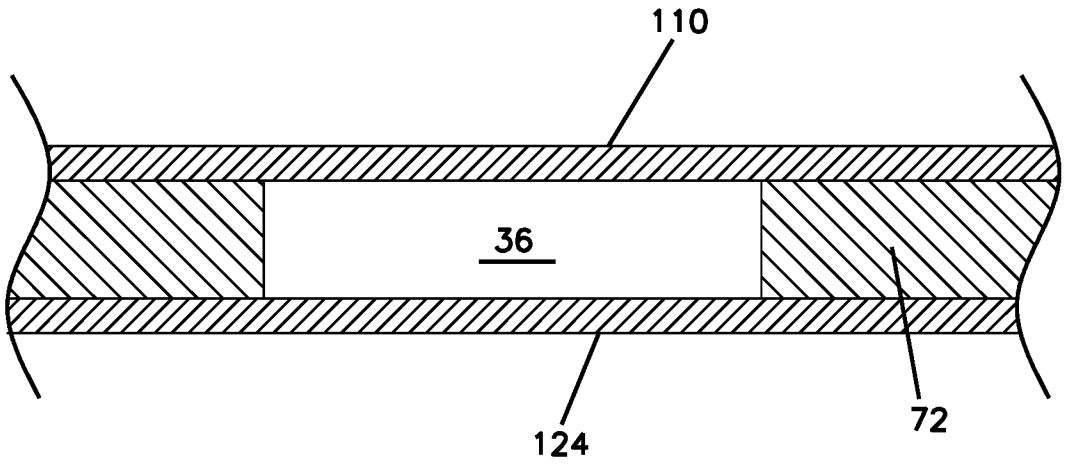
FIG. 11 is a cross sectional view of a rear portion of the garment of FIG. 1.
Figure 12:
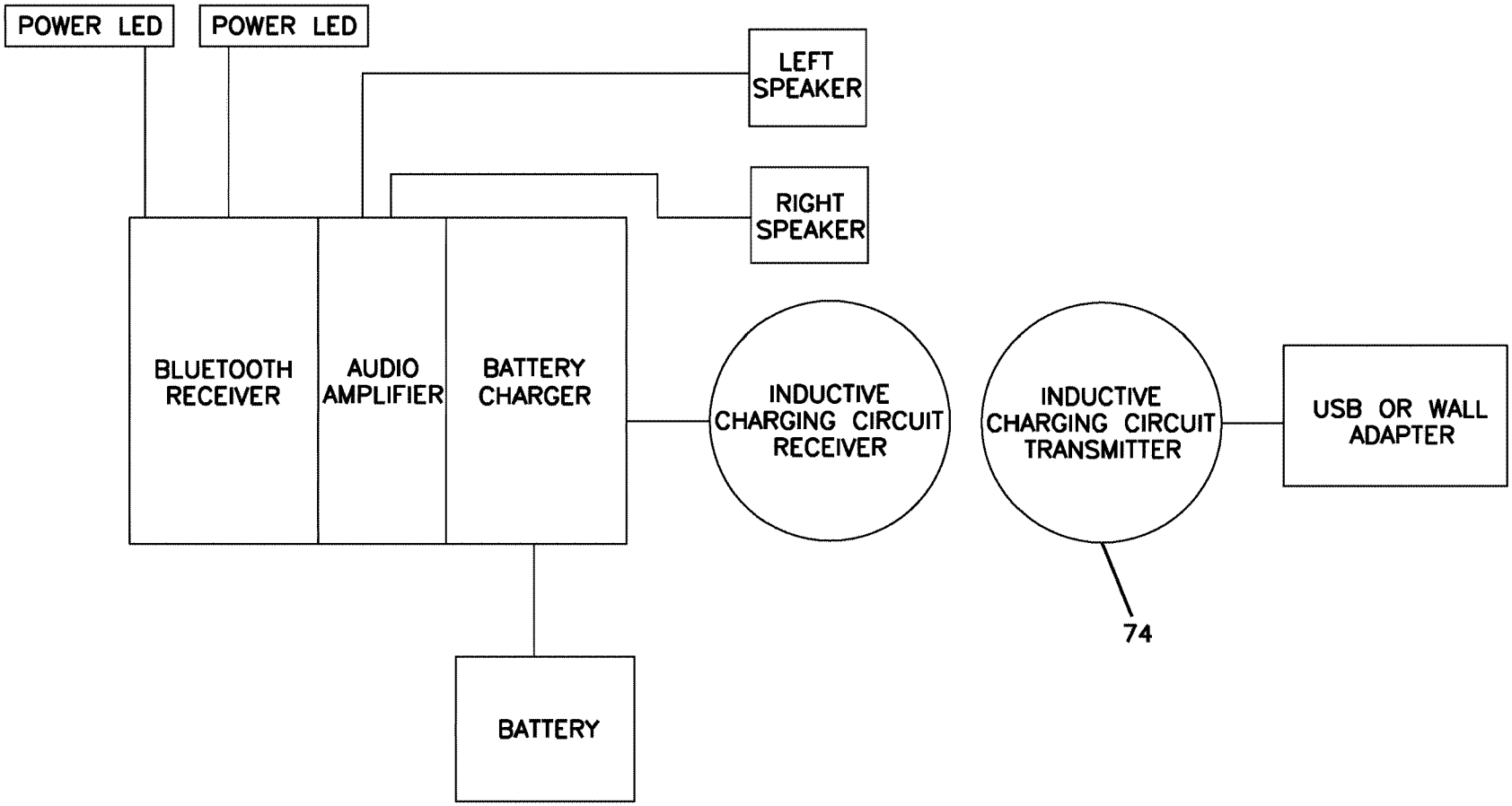
FIG. 12 is a block diagram of the electrical components of FIG. 9.
Figure 13:
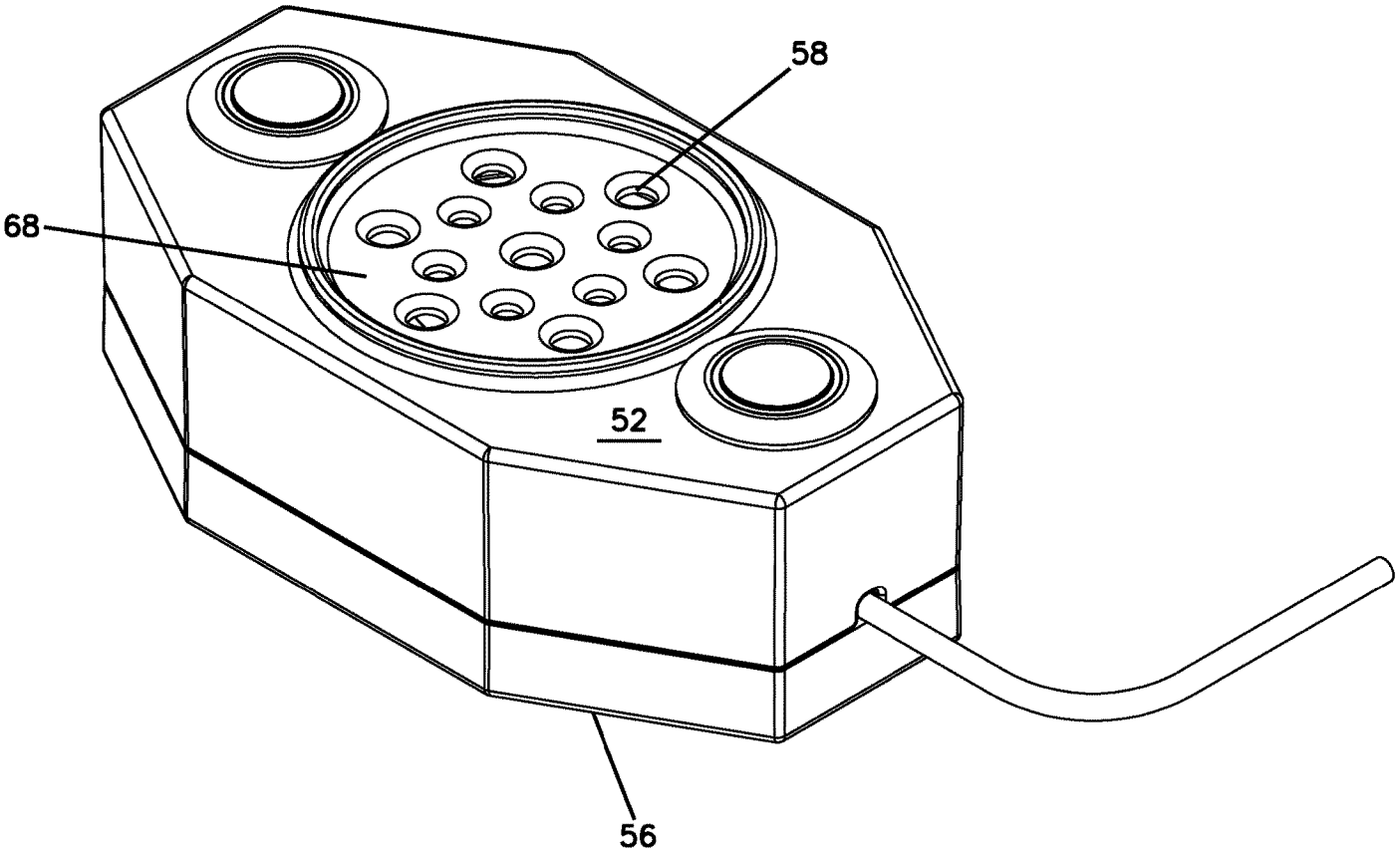
FIG. 13 is a perspective view of a component of the garment of FIG. 1.
Figure 14:
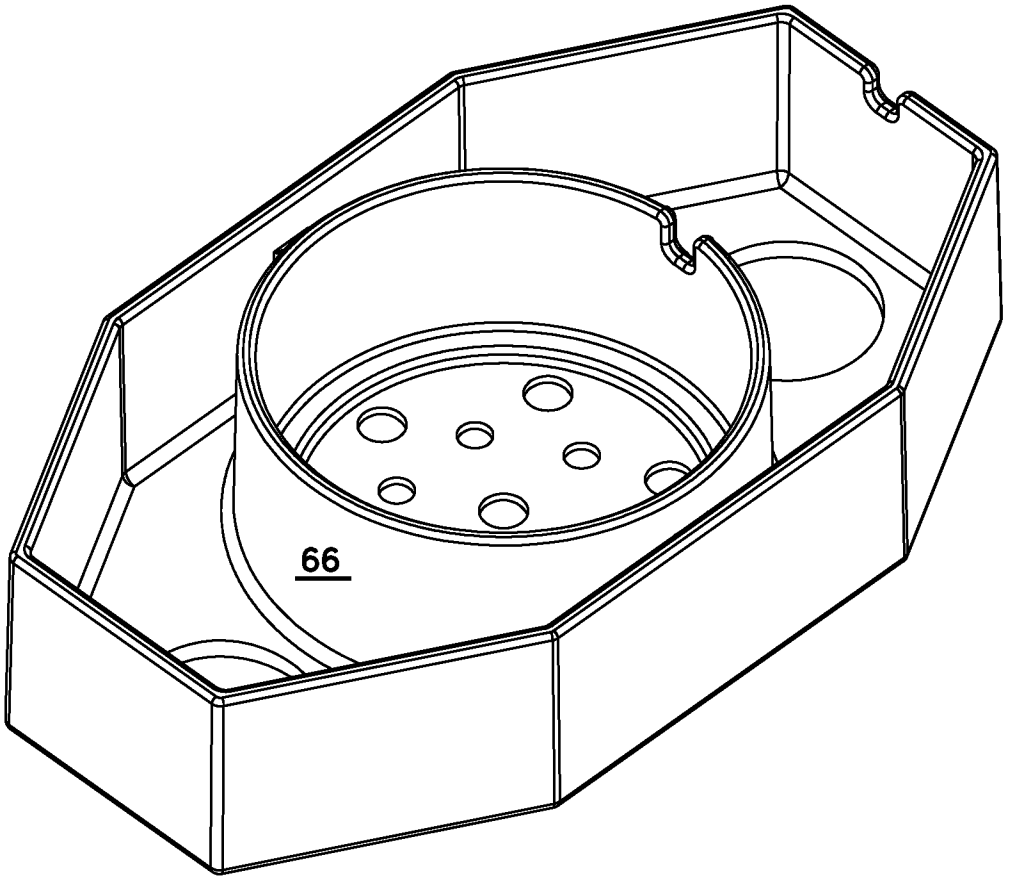
FIG. 14 is a cross sectional view of the component of FIG. 13.
Figure 15:
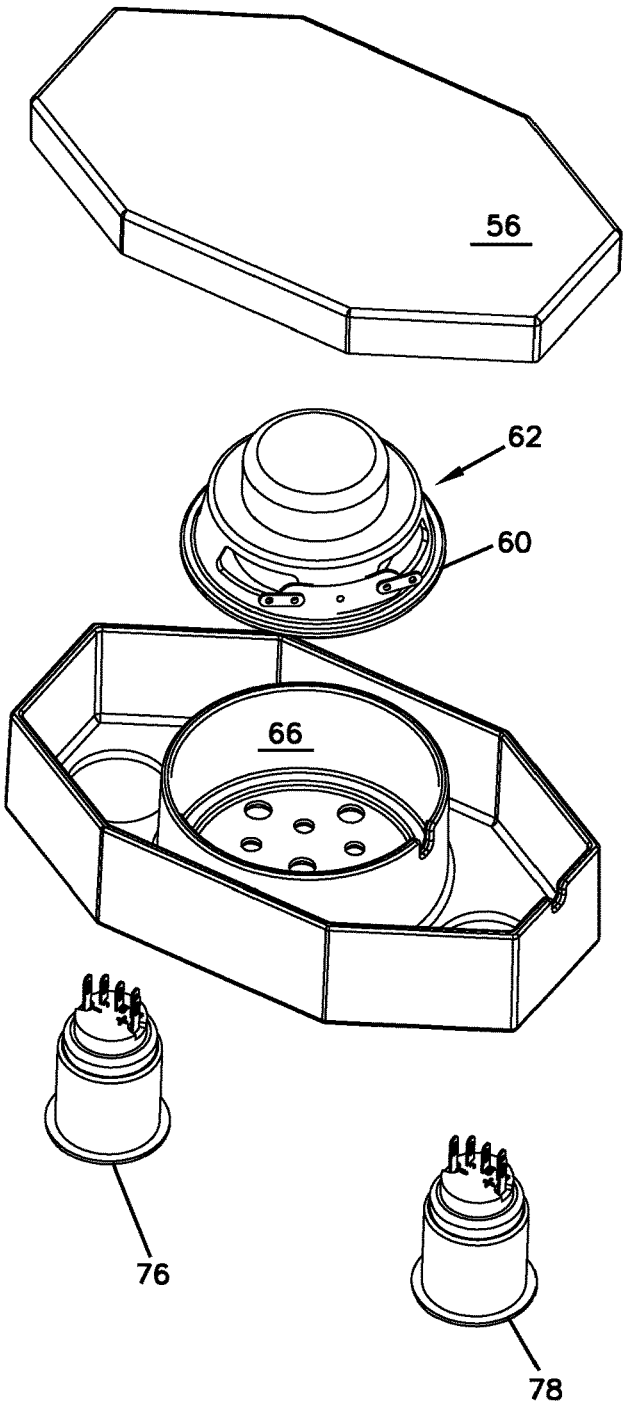
FIG. 15 is a perspective exploded view of the component of FIG. 13.
Figure 16:
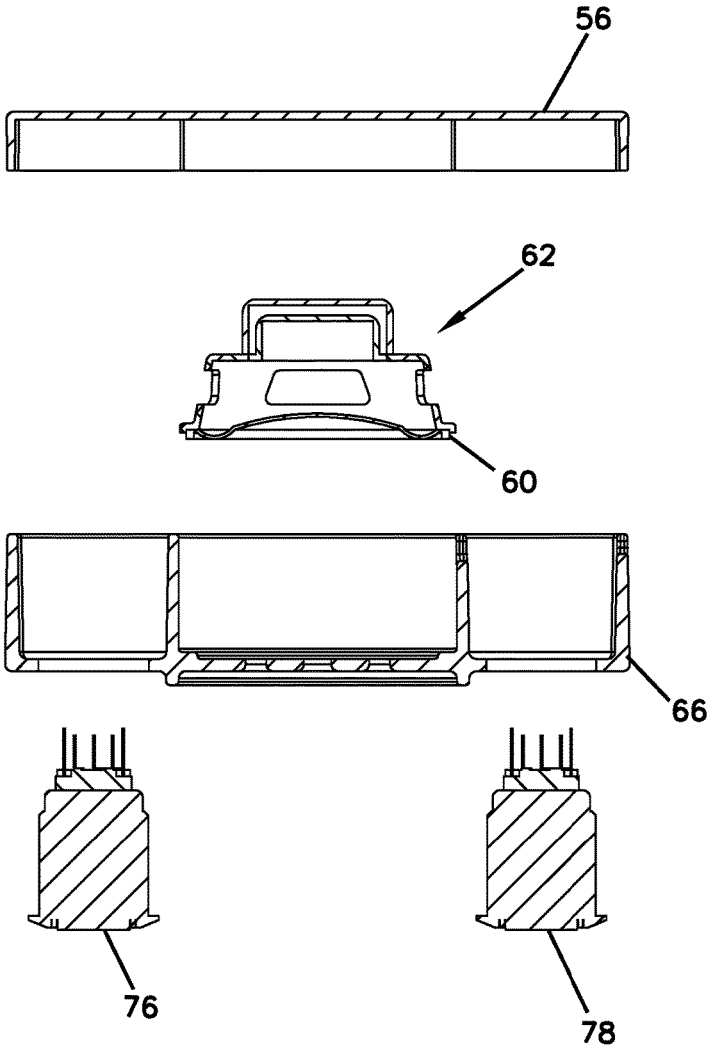
FIG. 16 is a perspective exploded view of the component of FIG. 13.
Figure 17:
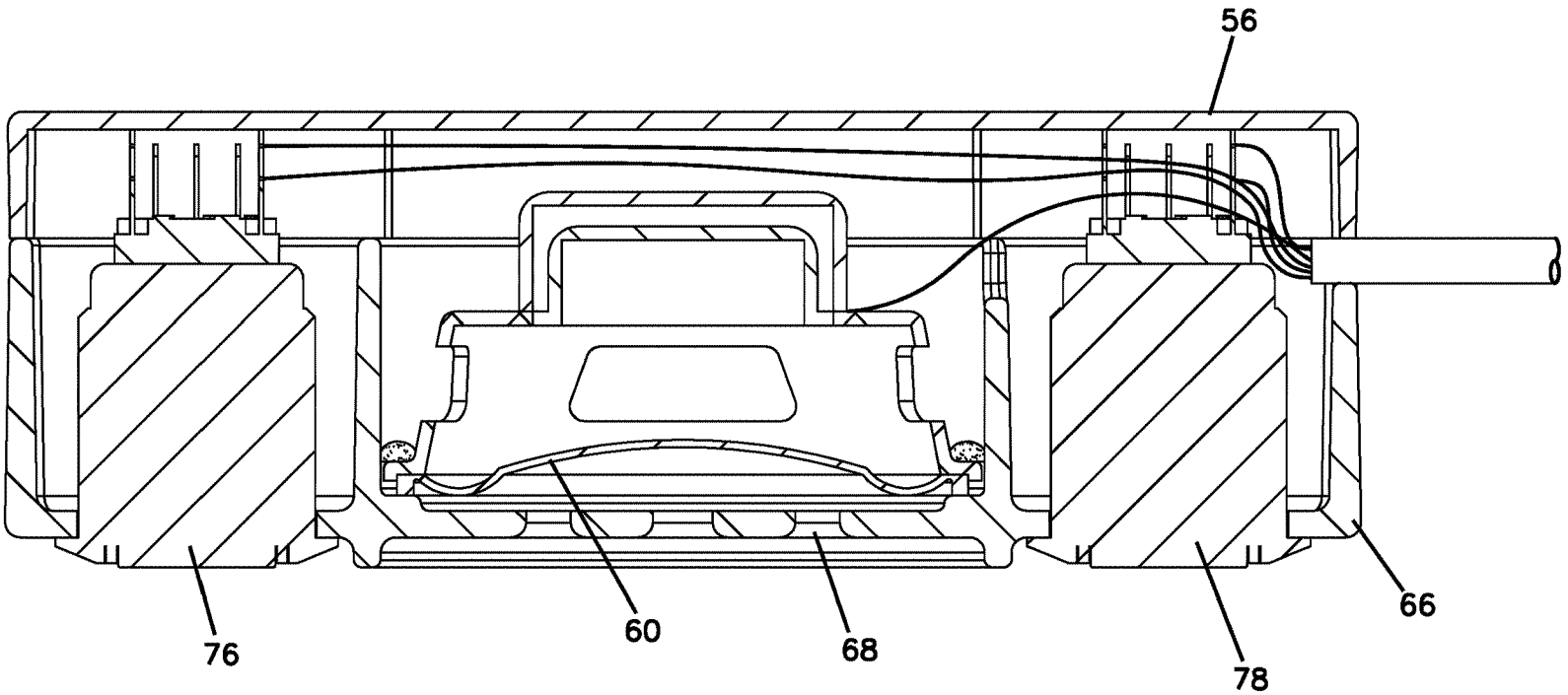
FIG. 17 is a perspective view of a portion of the component of FIG. 13.

Referring to the figures, the garment of the present disclosure is described in further detail. In the depicted embodiment, the garment 10 includes a body portion 80 that includes a back portion 12 and a front portion 20. The back portion 12 includes a rear upper shoulder portion 14 that includes a trapezoid covering portion 82 and a shoulder blade covering portion 84. The rear upper shoulder portion 14 includes a first layer 16 and a second layer 18. It should be appreciated that alternative configurations are possible.

In the depicted embodiment, the front portion 20 includes a front upper shoulder portion 22 that includes a collar bone covering portion 86. The front upper shoulder portion 22, 23 includes a first layer 24 and a second layer 26. In the depicted embodiment, the first layer 24 and second layers 26 are composite materials each including three sub layers. In the depicted embodiment, the front upper shoulder portions 22, 23 of the front portion 20 includes mesh openings 48, 50. In the depicted embodiment the first layer 24 and second layer 26 are flexible and stretch. It should be appreciated that many other alternative configurations are possible.

In the depicted embodiment, the garment 10 includes a first through channel 28 and a second through channel 30. The first and second through channels 28, 20 are provided between the front upper shoulder portion 22 of the front portion 20 and the rear upper shoulder portion 14 of the back portion 12 and also between the first layer 16 and second layer 18 of the back portion. In the depicted embodiment, the channels 28, 30 are also between the first layer 24 and the second layer 26 of the front upper shoulder portion 22. It should be appreciated that many other alternative configurations are also possible.

In the depicted embodiment, the garment 10 includes a left speaker enclosure 32 and a right speaker enclosure 34 provided in the front upper shoulder portion 22 of the front portion 20. In the depicted embodiment, the left and right speaker enclosures 32, 34 have at least a portion located between the first layer 26 and the second layer 26. In the depicted embodiment, the front face 52 of the left speaker enclosure 32 is located adjacent the mesh opening 48 and the front face 54 of the right speaker enclosure 34 is located adjacent the mesh opening 50. In the depicted embodiment, the left speaker enclosures 32, 34 are stitched between adjacent layers of the collar bone covering portion 86 of the front portion 20. It should be appreciated that many other alternative configurations are possible.

In the depicted embodiment, the left and right speaker enclosures 32, 34 include a waterproof construction. In the depicted embodiment, the left and right speaker enclosures include the same configuration. Accordingly, only the left speaker enclosure will be described in further detail herein.

In the depicted embodiment, the left speaker enclosure includes a body portion that includes a front face 52 and a rear face 56. The front face 52 including at least one aperture 58 therein that opens to a cone portion 60 of a speaker 62.

In the depicted embodiment, the cone portion 60 of the speaker 62 is arranged such that liquid (e.g., water) that comes into contact with the cone portion 60 will naturally drain away from the cone when the garment is a vertical position (normal position when the garment is worn). In the depicted embodiment, the cone portion 60 is at least partially exposed to the environment. In the depicted embodiment, control buttons 76, 78 secure the left and the right speaker enclosure 32, 34. In the depicted embodiment the control buttons 76, 78 are sealed to the speaker enclosure. It should be appreciated that alternative configurations are possible.

In the depicted embodiment, the aperture 58 is one of many apertures that are a part of a speaker protector/speaker guard 68. The speaker protector 68 is positioned over the cone portion 60 of the speaker (i.e., the cone portion 60 is positioned behind the perforated guard). In the depicted embodiment, the cone portion 60 is constructed of a waterproof material. The periphery edge 64 of the cone portion is sealed to a cylindrical sleeve 66 (internal tube) positioned within the left speaker enclosure 32. In the depicted embodiment, the cone portion 60 is located behind a perforated guard and sealed around its periphery from its back side within an internal tube 66. It should be appreciated that alternative configurations are possible.

In the depicted embodiment, the garment 10 includes a power and control box 36 provided in the rear upper shoulder portion 14 of the back portion 12 between the first layer 16 and the second layer 18. In the depicted embodiment, the power and control box 36 includes at least a battery 38, a control circuit 40, and an inductive charging coil 42. In the depicted embodiment, a charging unit 74 is provided that is configured to charge the battery 38 when the garment 10 is placed adjacent to the charging unit 74. It should be appreciated that many alternative configurations are also possible (e.g., alternative configuration may include a removable battery and/or a batter that is charged via a wired connection).

In the depicted embodiment, a plurality of closed cell foam pads 70 are stitched between the first layer 16 and second layer 16 of the back portion 12 and the first layer 24 and second layer 26 of the front portion 20. In the depicted embodiment, the power and control box 36 is nested within a foam pad 72. In the depicted embodiment, the power and control box 36 recessed within the shoulder blade covering portion 84 of the back portion 12. It should be appreciated that alternative configurations are possible.

In the depicted embodiment, the garment 10 includes a first wire 44 extending between the left speaker enclosure 32 to the power and control box 36. The first wire 44 extends through the first through channel 28. In the depicted embodiment, the garment 10 includes a second wire 46 extending between the right speaker enclosure 34 to the power and control box 36. The second wire 46 extends through the second through channel 30. In the depicted embodiment, a first set of control wires extend from the left speaker enclosure 32 located in the front covering portion to the power control box 36 located in the back covering portion and a second set of wires control wires extend from the right speaker enclosure 34 located in the front covering portion to the power control box 36 located in the back covering portion. In the depicted embodiment, the first set of control wires and the second set of control wires are free floating within the through channel 28, 30.

The present disclosure also provides a method of manufacturing a garment having integrated waterproof speakers. In the depicted embodiment, the method can include the step of cutting a first pattern from a first material to form an inside layer 100. The periphery edge of the inside layer can include a right closure edge 102, a front right neck edge 104, a right front shoulder edge 106, a right arm hole edge 108, a right rear shoulder edge 110, a rear neck edge 112, a left rear shoulder edge 114, a left arm hole edge 116, a left front shoulder edge 118, front left neck edge 120, and a left closure edge 122. The method can include the step of cutting a second pattern from a second material to form an outside layer 124. The periphery edge of the outside layer 124 matches the periphery of the inside later 100 and can include a right closure edge 126, a front right neck edge 128, a right front shoulder edge 130, a right arm hole edge 132, a right rear shoulder edge 134, a rear neck edge 136, a left rear shoulder edge 138, a left arm hole edge 140, a left front shoulder edge 142, front left neck edge 144, and a left closure edge 146. It should be appreciated that many alternative patterns are also possible.

The disclosed method can include the step of cutting apertures 148, 150 in a left shoulder zone 152 and right front shoulder zone 154 of the outside layer to create a left speaker outlet and a right speaker outlet. The method can also include the step of stitching mesh material 156, 158 over the left speaker outlet and the right speaker outlet. The method can also include the step of stitching a first zipper portion 160 between the inside layer 100 and outside layer 124 along the right closure edge 102, 126 and stitching a second zipper portion 162 between the inside layer 100 and outside layer 124 along the left closure edge 122, 146. It should be appreciated that many alternative steps are also possible.

The method can include the step of stitching a plurality of foam pads 164, 166, 168 between the inside layer 100 and outside layer 124. The method can include the step of stitching the right front shoulder edge 130 of the outside layer 124 to the right rear shoulder edge 134 of the outside layer 136. The method can include the step of stitching the right front shoulder edge 106 of the inside layer 100 to the right rear shoulder edge 110 of the inside layer 100 thereby creating a first shoulder channel 170. It should be appreciated that many alternative steps are also possible.

The method can include the step of electrically connecting a sealed left speaker enclosure 32 to a power and control box 36 via a first wire 44 and electrically connecting a sealed right speaker enclosure to the power and control box via a second wire 46. The method can include the step of placing the sealed left speaker enclosure 32 between the inside layer 100 and outside layer 124 such that the face of the left speaker enclosure is adjacent the left speaker outlet and placing the right speaker enclosure 34 between the inside layer 100 and outside layer 124 such that the face of the sealed right speaker enclosure is adjacent the right speaker outlet. It should be appreciated that many alternative steps are also possible.

The method can include the step of placing the power and control box 36 between the inside layer 100 and outside layer 124 below the rear neck edge 112, 136. The method can include the step of arranging the first wire 44 though the first shoulder channel 170 and arranging the second wire 46 through the second shoulder channel. It should be appreciated that many alternative steps are also possible.

The method can include the step of stitching the front right neck edge 104 of the inside layer 100 to the front right neck edge 128 of the outside layer 124, stitching the right arm hole edge 108 of the inside layer 100 to the right arm hole edge 132 of the outside layer 124, stitching the rear neck edge 112 of the inside layer 100 to the rear neck edge of the outside layer 124, stitching the left arm hole edge 116 of the inside layer 100 to the left arm hole edge 140 of the outside layer 124, stitching the front left neck edge 120 of the inside layer 100 to the front left neck edge 144 of the outside layer 124. It should be appreciated that many alternative steps are also possible.

The method can include the steps of assembling the sealed left speaker enclosure, wherein steps include: inserting a circular profile speaker 62 into a cylindrical tube structure/cylindrical sleeve 66. In the depicted embodiment, the tube structure is open to a front portion 52 of a speaker enclosure 32. The method can include the step of sealing the periphery of the speaker to cylindrical tube structure and melting a rear cap over the rear portion of the speaker enclosure to seal the speaker enclosure.

The method can also include the step of arranging a first set of wires though the first channel and arranging the second set of wires through a second channel and proving a first and second set of wires that are 150% the length of the distance between the left speaker and the power and control box.

Various modifications and alterations of this disclosure will become apparent to those skilled in the art without departing from the scope and spirit of this disclosure, and it should be understood that the scope of this disclosure is not to be unduly limited to the illustrative examples set forth herein.

We claim:

1. A garment comprising:

a body portion including a front portion and a back portion, the body portion including a first and a second layer;

a first speaker unit positioned at the front portion, the first speaker unit having at least a portion located between the first layer and the second layer;

a second speaker unit positioned at the front portion, the second speaker unit having at least a portion located between the first layer and the second layer, wherein the first and second speaker units are connected to a power and control box;

a first set of control wires extending between the first speaker unit and the power and control box, wherein the first set of control wires extends between the first and second layers; and a second set of control wires extending between the second speaker unit and the power and control box, wherein the second set of control wires extends between the first and second layers.

2. The garment of claim 1, wherein the back portion includes a rear upper shoulder portion, wherein the front portion includes a front upper shoulder portion, and wherein at least a first through channel and a second through channel are provided between the first and second layers of the front and rear upper shoulder portions of the front portion and the back portion.

3. The garment of claim 1, wherein the first and second speaker units are provided in a front upper shoulder portion of the front portion.

4. The garment of claim 1, wherein the left and right speaker units include a waterproof construction.

5. The garment of claim 1, wherein the power and control box is securable and retainable in the back portion of the body portion.

6. The garment of claim 1, wherein the power and control box is provided in a rear upper shoulder portion of the back portion between the first layer and the second layer, the power and control box including at least a battery and a control circuit.

7. The garment of claim 1, wherein upper shoulder portions of the front portion include at least one mesh opening located adjacent at least one of a front face of the first speaker unit and the second speaker unit.

8. The garment of claim 1, wherein the first and second speaker units include a body portion that includes a front face and a rear face, the front face including at least one aperture therein that opens to a cone portion of a speaker.

9. The garment of claim 8, wherein the cone portion is constructed of a waterproof material, wherein a periphery edge of the cone portion is sealed in a cylindrical sleeve positioned within the first and second speaker units.

10. A garment comprising:

a body portion including a front portion and a back portion, the body portion including a first and a second layer;

at least one speaker unit secured and retained at the front portion;

a power and control box securable and retainable in the back portion; and a first set of control wires extending between the at least one speaker unit and the power and control box, wherein the first set of control wires extends between the first and second layers.

11. The garment of claim 10, further comprising a second speaker unit secured and retained at the front portion and a second set of control wires extending between the second speaker unit and the power and control box, wherein the second set of control wires extends between the first and second layers.

12. The garment of claim 10, wherein the back portion includes a rear upper shoulder portion, wherein the front portion includes a front upper shoulder portion, and wherein at least a first through channel is provided between the first and second layers at the upper shoulder portions of the front portion and the back portion.

13. The garment of claim 12, further comprising a second through channel between the first and second layers at the upper shoulder portions of the front portion and the back portion.

14. The garment of claim 10, wherein the at least one speaker unit has a waterproof construction.

15. The garment of claim 10, wherein the power and control box is provided in a rear upper shoulder portion of the back portion between the first layer and the second layer, the power and control box including at least a battery and a control circuit.

16. The garment of claim 10, wherein upper shoulder portions of the front portion include at least one mesh opening located adjacent a front face of the at least one speaker unit.

17. The garment of claim 10, wherein the at least one speaker unit includes a body portion that includes a front face and a rear face, the front face including at least one aperture therein that opens to a cone portion of a speaker.

18. The garment of claim 17, wherein the cone portion is constructed of a waterproof material, wherein a periphery edge of the cone portion is sealed in a cylindrical sleeve positioned within the at least one speaker unit.

19. The garment of claim 10, wherein the at least one speaker unit is provided in a front upper shoulder portion of the front portion.

20. A garment comprising:

a body portion including a front portion and a back portion, the body portion including a first and a second layer;

at least one speaker unit secured and retained at a front upper shoulder portion of the front portion;

a power and control box securable and retainable in a rear upper shoulder portion of the back portion at least partially between the first layer and the second layer; and a first set of control wires extending between the at least one speaker and the power and control box, wherein the first set of control wires extends between the first and second layers.

21. The garment of claim 20, further comprising a second speaker unit secured and retained at the front upper shoulder portion of the front portion, and a second set of control wires extending between the second speaker unit and the power and control box, wherein the second set of control wires extends between the first and second layers.

* * * * *